United States Patent [19]

Machura et al.

[11] Patent Number: 5,060,373

[45] Date of Patent: Oct. 29, 1991

[54] METHODS FOR MAKING COAXIAL CONNECTORS

[75] Inventors: Bernard C. Machura, Oak Brook; Eugene J. Mysiak, Lisle, both of Ill.

[73] Assignee: The Phoenix Company of Chicago, Inc., Wood Dale, Ill.

[21] Appl. No.: 396,991

[22] Filed: Aug. 22, 1989

[51] Int. Cl.[5] ..... H01R 43/00

[52] U.S. Cl. ..... 29/858; 29/860; 174/153 R

[58] Field of Search ..... 29/828, 858, 860; 174/153 R

[56] References Cited

U.S. PATENT DOCUMENTS

| | | | |
|---|---|---|---|
| Re. 32,691 | 6/1988 | Dola et al. | 29/858 X |
| 3,136,591 | 6/1964 | Just et al. | 174/153 X |
| 3,156,920 | 11/1964 | Mysiak . | |
| 3,281,756 | 10/1966 | O'Keefe et al. | 29/828 X |
| 3,733,695 | 5/1973 | Frey, Jr. et al. | 29/860 X |
| 3,879,103 | 4/1975 | Peltola et al. | 439/581 |
| 3,910,665 | 10/1975 | Stull . | |
| 3,915,535 | 10/1975 | O'Keefe et al. . | |
| 3,951,491 | 4/1976 | Mysiak . | |
| 4,015,329 | 4/1977 | Hutchison | 29/858 |
| 4,029,385 | 6/1977 | Mysiak et al. . | |
| 4,036,545 | 7/1977 | Mysiak et al. . | |
| 4,360,244 | 11/1982 | Forney, Jr. et al. | 439/581 |
| 4,377,321 | 3/1983 | Weisenburger . | |
| 4,412,717 | 11/1983 | Monroe | 439/581 |
| 4,453,796 | 6/1984 | Monroe | 439/581 |
| 4,598,961 | 7/1986 | Cohen . | |
| 4,607,903 | 8/1986 | Hoshino et al. . | |
| 4,611,867 | 9/1986 | Ichimura et al. . | |
| 4,615,115 | 10/1986 | Bosshard et al. | 29/860 |
| 4,624,525 | 11/1986 | Ichimura et al. . | |
| 4,645,288 | 2/1987 | Stursa . | |
| 4,701,001 | 10/1987 | Verhoeven . | |
| 4,795,352 | 1/1989 | Capp et al. . | |

FOREIGN PATENT DOCUMENTS

| | | |
|---|---|---|
| 1231403 | 1/1988 | Canada . |
| 0327308 | 8/1989 | European Pat. Off. . |
| 2222768 | 10/1974 | France . |

OTHER PUBLICATIONS

AMP Incorporated, Catalog, "AMPLIMITE Subminiature D Military Connectors", p. 8, Coaxial and Power Contacts for Series 109 Housings with Power/Coax and Signal Mix, pp. 15–19.

Allied Amphenol Products, *Amphenol Industrial Line Connector, "Amphenol Sub-miniature Coaxial Connectors"*, Catalog No. F122-00058, Issue Mar. 3, 1986, pp. 92, 118, 192–198.

(List continued on next page.)

*Primary Examiner*—P. W. Echols
*Assistant Examiner*—Carl J. Arbes
*Attorney, Agent, or Firm*—Welsh & Katz, Ltd.

[57] ABSTRACT

A receptacle connector and a plug connector for connecting a coaxial cable of 75 ohms or greater to a printed circuit board without affecting the outside configuration of their shells. At one end, the receptacle connector forms a spring contact receiver portion for resiliently retaining the plug end of the plug connector. The plug connector terminates a coaxial cable at its other end. The receiver portion of the receptacle connector is right-angled to a three-legged terminal section for solder connection at the printed circuit board. The receptacle and plug connectors comprise an outer shell member, a dielectric member, and a center conductor. The shell members are stamped and formed to maintain an exact constant inside diameter to the shells. The center conductors are stamped and formed to maintain an exact but variable outside diameter which is used to change the terminating impedance of the respective connector. The center conductors are subsequently insert molded into the dielectric members during their formation. The molded dielectric members are preferably of an insulative and low dielectric constant material, such as Teflon. The connectors are assembled by forming the outer shells around the dielectric members which have locating means for determining a positive relationship between the shells and dielectric members.

24 Claims, 14 Drawing Sheets

OTHER PUBLICATIONS

ITT Cannon, *D Subminiature Rectangular Connectors,* catalog pp. 35, 36, 37, and 44.

FCT Electronic GmbH, *D-Subminiature Mixed Layout Connectors,* Catalog No. ML 1-88, pp. 1, 4, 6, 13, and 15.

General Connector Corporation, *Sub-Rectangular-GM Contacts: Coaxial/Hi-Voltage/Hi-Power,* Catalog 4M 684 R2, pp. 17-20.

Positronic Industries, Inc., *Handbook of International Subminiature-Connectors,* Catalog "Industrial and Military Quality Subminiature-D Connectors", pp. 55-64.

Sealectro Corp., *Coaxial Connectors Quick-Reference Catalog,* Catalog QR-6, "Connex Specifications", pp. 3-10, 13, SMA Connectors, pp. 15-17, Nanohex Connectors, pp. 24-34.

Stetco, Inc. Electronics Company, "HF Coaxial Inserts", pp. 54-61.

Sealectro BICC Electronics, "50 and 75 Ohm Coaxial DIN Inserts", (2 pages).

Palco Connector, "PDM, PDM-50, PDM-Z/P", Catalog No. 387L5M, pp. 2-6.

The Phoenix Company of Chicago, "D-Subminiature Combination Connectors, Coax Contacts, High Power Contacts, Solderless Contacts", Catalog, pp. 3, 6-9.

Applied Engineering Products, advertisement (1 p.).

Hubbard, "Specification and Testing of Megahertz Range Coaxial Connectors", *Connection Technology,* Aug. 1989, pp. 19-21.

Morelli, "Coaxial Connector Trend", *Connection Technology,* Mar. 1986, pp. 161 ∝ 19.

Hirose Electric U.S.A., Inc., *Connection Technology,* Jul. 1988, advertisement, p. 15.

Semflex, Inc., *Connection Technology,* Aug. 1989, advertisement, p. 49.

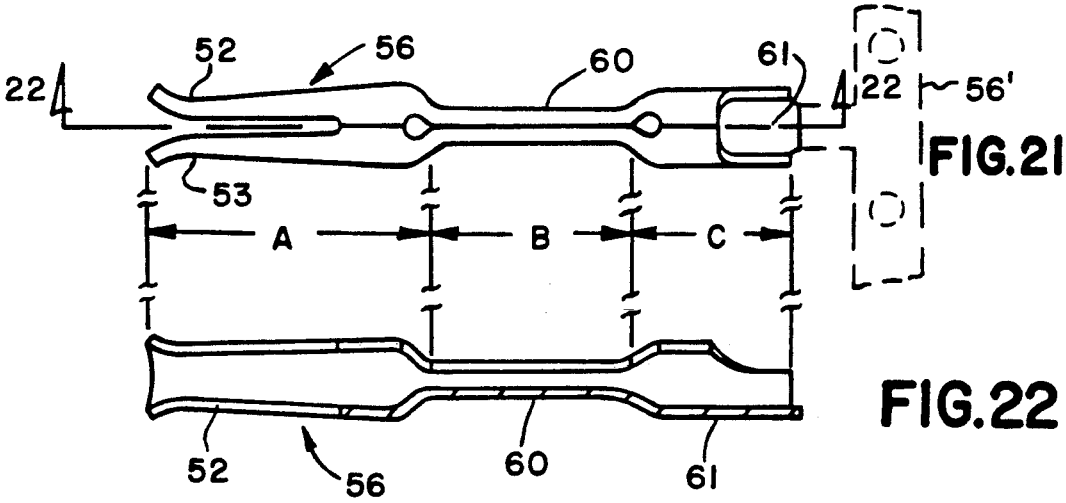
FIG.21
FIG.22
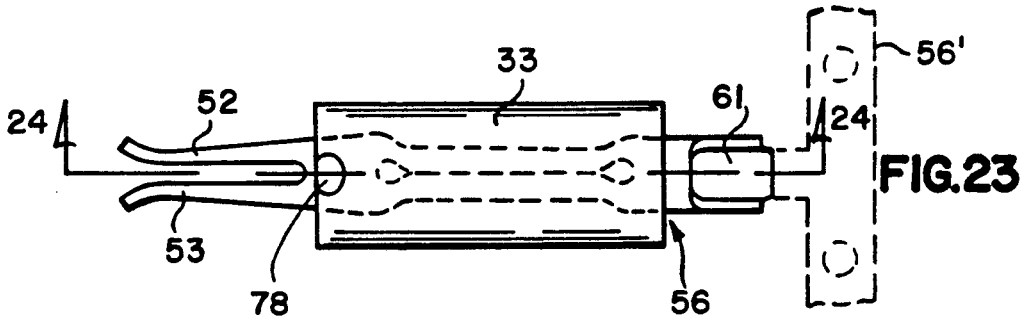
FIG.23
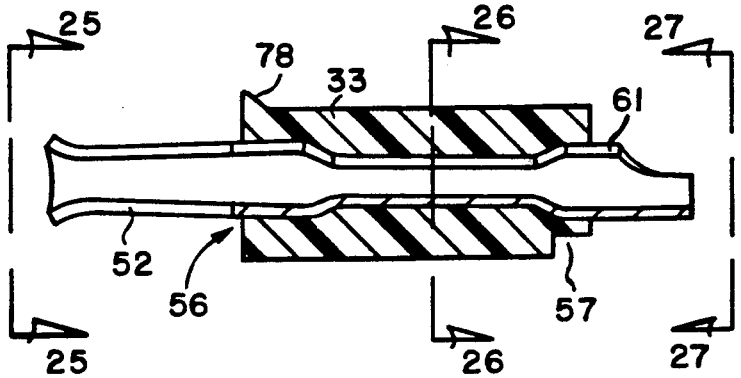
FIG.24
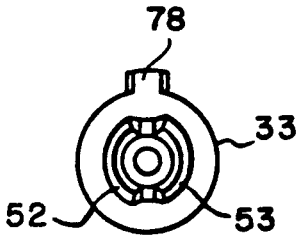
FIG. 25
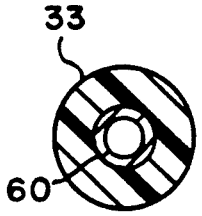
FIG. 26
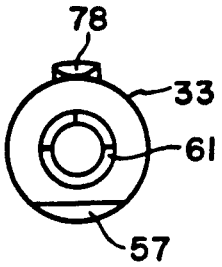
FIG. 27

METHODS FOR MAKING COAXIAL CONNECTORS

FIELD OF THE INVENTION

The invention pertains generally to coaxial connectors, and more particularly to coaxial connectors with a receptacle end and an end adapted for printed circuit board mounting and coaxial connectors with a plug end and an end adapted for coaxial cable termination.

BACKGROUND OF THE INVENTION

A coaxial cable is an electrically conducting cable containing two or more conductors, each isolated from the others and running parallel to the others. Generally, such cables have a center conductor embedded in a dielectric, a woven or braided metallic shield surrounding the dielectric, and an outer insulating jacket which surrounds the shield. The center conductor carries a UHF or VHF radio frequency signal while the braided conductor acts as an electromagnetic shield to prevent interference with the radio frequency signal.

A coaxial connector is a device for connecting a coaxial cable to a different electronic medium, for example, a printed circuit board. In many instances, it is desirable to connect various types of signal conductors to a printed circuit board other than just a coaxial cable. For these cases combination connectors are used which have both coaxial connectors and pin connectors arranged in an array in the same connector housing. One of the conventional connectors of this type includes a subminiature D housing having a female connector (receptacle) mateable with a male connector (plug). Other combination configurations are known and it is evident that connectors which fit into a combination housing may be used individually for connection. The main function of such coaxial connectors is to provide a reliable and acceptable connection to coaxial cables of a given size.

In addition to providing a reliable and acceptable connection for a coaxial cable, it is another desirable attribute of a coaxial connector to provide for the maintenance of the characteristic impedance of the coaxial cable to which it is connected. In this regard, many previous coaxial connectors have had an upward limit of approximately 50 ohms. This is because the characteristic impedance Z of a connector is dependent upon the outer diameter of the inner conductor and the inner diameter of the outer housing which are relatively fixed. In many instances, the outer housing of a coaxial connector is manufactured by a machining process and such process determines the characteristics of the material from which it is made, i.e., the material must be hard enough to chip during machining and must be of a particular thickness to withstand the process. Because the outer diameter of such coaxial connectors is generally fixed by convention or standards, this produces a coaxial connector with a limitation on the inner diameter of the outer shell.

Further, many of the center conductors of coaxial connectors are pushed into a bore of a preformed dielectric member before assembly to the shell member of the coaxial connector. This process, because of the stiffness required for the center conductor, essentially defines the minimum outer diameter of the inner conductor. This again substantially limits the final impedance of the connector.

However, there are new applications for coaxial connectors which require such terminations to be of significantly higher impedance. For example, in the telecommunications and computer industry, a coaxial should be terminated at approximately 75 ohms. This would create significant power loss if the standard 50 ohm connector is used.

One particularly advantageous coaxial connector for printed circuit boards is the receptacle end connector which is right-angled to a terminal end that allows a coaxial cable to be connected parallel to the plane of the printed circuit board. Such connectors have been suggested in the prior art, but have been inadequate in providing a low cost, inexpensive connector which can meet the impedance requirements of the present telecommunication and computer industries.

There have additionally been several problems in the manufacturing of coaxial connectors which increase their cost. Many of the coaxial connector shells are produced by a screw machining process which has a number of disadvantages. First, the screw-machined outer shell is inherently constructed of several piece parts which does not lend itself to further simplified automated handling in the assembly process. Secondly, it is not readily adaptable between separate sizes of connectors and combination connectors. In fact, it is somewhat difficult to design and assemble separate retention means for the connector shells after they have been made.

Another difficulty is not being able to perform selective plating of contact metals on the connectors. Optimally, one would only plate noble contact metal in the places that the connector made a frictional fit with another connector. The present method is to barrel plate the entire connector shell, because selective plating of individual piece parts is even more expensive. However, significant plating material is wasted in this process.

Moreover, the screw machine connector does not lend itself to sub-microminiaturization. New connectors will be required for denser circuit arrays in the future and complete redesigns of the present connectors for materials and sizes will be required for machined connectors. It would be highly advantageous to find a process for making coaxial connectors which could be easily scaled to denser configurations without changing materials, process and design parameters.

The material, Beryllium Copper, which is generally used for making screw-machined connector shells is relatively expensive and granular in structure. The hardness of the material must be suitable for ease of machining which limits its thickness. The spring finger contacts of a receptacle connector are formed by a secondary slitting or sawing operation on the shell. With this type of shell it is difficult to calculate the stresses and the normal forces required for the proper contact engagement and the durability of the contact. One must generally rely on the spring properties of expensive Beryllium Copper and sometimes provide an additional heat treatment operation.

SUMMARY OF THE INVENTION

It is therefore a general object of the present invention to provide improved coaxial cable connectors of simple and inexpensive construction.

It is another object of the present invention to provide an improved coaxial cable connector with a receptacle end right-angled to a printed circuit board terminal end of simple and inexpensive construction.

It is another object of the invention to provide an improved coaxial cable connector with a plug end and cable termination end of simple and inexpensive construction.

Still another object of the invention is to provide coaxial connectors which exhibit precise impedance matching over a wide range of frequencies.

Another object of the invention to provide coaxial connectors with increased impedance ratings which can match coaxial cables of 75 ohms or more.

It is yet another object of the invention to reduce the cost of manufacturing coaxial connectors by using the least number of piece parts, the most efficient piece part manufacturing processes, and manufacturing and assembly techniques which are the most compatible with automation.

It is one more object of the invention to provide coaxial connectors, of either the plug or receptacle types, which can alternatively be used alone or in a combination grid.

Another object of the invention is to assure interchangeability of coaxial connectors, of either the plug or receptacle types, with the established standards for the D-subminiature and 41612 DIN combination connector grids (and other geometric parameters) which also qualify for the performance requirements of these standards.

It is yet another object of the invention to manufacture coaxial connectors by a process which can be conveniently adapted to miniaturize VHF/UHF coaxial connectors and/or combination connector to the sub-microminiature level, i.e., with a greater density of a 0.050 in.×0.050 in. grid size.

In accordance with the invention, a first embodiment provides a coaxial receptacle connector with a receptacle end for connecting a plug-ended coaxial cable to a printed circuit board. Preferably, at the receptacle end a spring contact receiver means is provided for resiliently retaining the plug end of the coaxial cable, and at the other end, a three-legged terminal configuration for solder connection to a printed circuit board is provided. The receiver means is right-angled to the terminal end to allow the coaxial cable to be mounted parallel to the plane of the printed circuit board.

In a preferred implementation, the receptacle connector comprises a stamped and formed outer shell member, a dielectric member, and an insert molded right angle center conductor. The shell member is stamped and formed to maintain an exact inside diameter to the shell. Integral with the outer shell are retaining means which permit the connector to be mounted in a combination housing. The center conductor is machined to maintain an exact but variable outside diameter. The center conductor is subsequently insert molded into the dielectric member. The dielectric member is then assembled into the stamped and formed shell member which has locating means for a positive positioning between the shell and dielectric member.

In accordance with the invention, a second embodiment provides a coaxial plug connector with a plug end for connecting to the receptacle connector and a coaxial end for connecting to a coaxial cable. The plug end mates resiliently with the receiver portion of the receptacle connector and the coaxial end comprises a solder cup and shield retaining means for connection to the coaxial cable.

In one implementation, the plug connector comprises a stamped and formed outer shell member, a dielectric member, and an insert molded center conductor. The shell member is stamped and formed to maintain an exact inside diameter to the shell. Integral with the outer shell are retaining means which permit the connector to be mounted in a combination housing. The center conductor is stamped and formed to maintain an exact but variable outside diameter. The center conductor is subsequently insert molded into the dielectric member. The connector is then assembled with the formed shell around the dielectric member which has locating means for a positive positioning between the shell and dielectric member.

The stamping and forming process provides a facile method for precisely matching a desired impedance. In these processes, the inner diameter of the shell and the outer diameter of the inner conductor can be maintained to very close tolerances. By keeping the inner diameter of the outer shell constant and by varying the outer diameter of the inner conductor, precise impedance matching over a wide range of values is possible.

Moreover, because of the material used for the outer shell and its unitary design, the inner diameter of the outer shell can be increased while still retaining a standard outside diameter. Because the inner conductor is insert molded, a much thinner conductor can be used thereby reducing its outer diameter. Both of these factors contribute to the ability to increase the impedance ratings of coaxial connectors to 75 ohms or more, while meeting other standard design parameters.

The manufacturing process and the design of the connectors lend themselves to an inexpensive assembly process which has a reduced number of piece parts to handle and which is adaptable to automation. The number of piece parts for assembly has been reduced to two, the outer shell and the dielectric member and the center conductor combination. The separate functional elements for contact, retention, and termination are integrally formed in one of the parts, the outer shell.

The stamping and forming process using the metal center conductor and the metal outer shell are low cost operations which permit selective plating or even preplating with noble contact metals only where they are needed. The process further permits the pieces to be attached to carriers which can position and move a multiplicity of piece parts simultaneously for automated assembly. The stamping, forming, and molding processes also allow a miniaturization of the connectors by scaling down sizes and thicknesses without significant changes in the design or assembling process. Thus, greater densities to the sub-microminiature level can be achieved while retaining the advantages of the low cost assembly and production processes. The sub-microminiature size can also be rated at 50 ohms, or greater, to operate at the GHz level with precise impedance matching.

The stamping process additionally provides a convenient and inexpensive technique for combining stiffening ribs with the terminal legs of the receptacle connector. These ribs which are formed integrally with the outer shell are extremely advantageous in that they produce enough stiffness in the small cross-section of the terminal legs to withstand an automated or a robotic assembling process without bending or misaligning. Such compatibility with automated handling equipment permits the connectors to be manufactured with terminals for either through-hole or surface mounting techniques on printed circuit boards.

These and other objects, features, and aspects of the invention will become clearer and more fully understood when the following detailed description is read in conjunction with the appended drawings wherein:

BRIEF DESCRIPTION OF THE DRAWINGS

FIG. 21 is a top view of the center conductor of the plug connector;

FIG. 22 is a cross-sectional side view of the center conductor taken along view lines 22—22 in FIG. 21;

FIG. 23 is a top view of the center conductor and dielectric member combination:

FIG. 24 is a cross-sectional side view of the center conductor and dielectric member combination taken along view lines 24—24 in FIG. 23;

FIG. 25 is a front view of the center conductor and dielectric member taken along view lines 25—25 in FIG. 4;

FIG. 26 is a cross-sectional front view of the center conductor and dielectric member taken along view lines 26—26 in FIG. 24;

FIG. 27 is an end view of the center conductor and dielectric member taken along view lines 27—27 in FIG. 4;

DETAILED DESCRIPTION OF THE PREFERRED EMBODIMENTS

Figure 1:
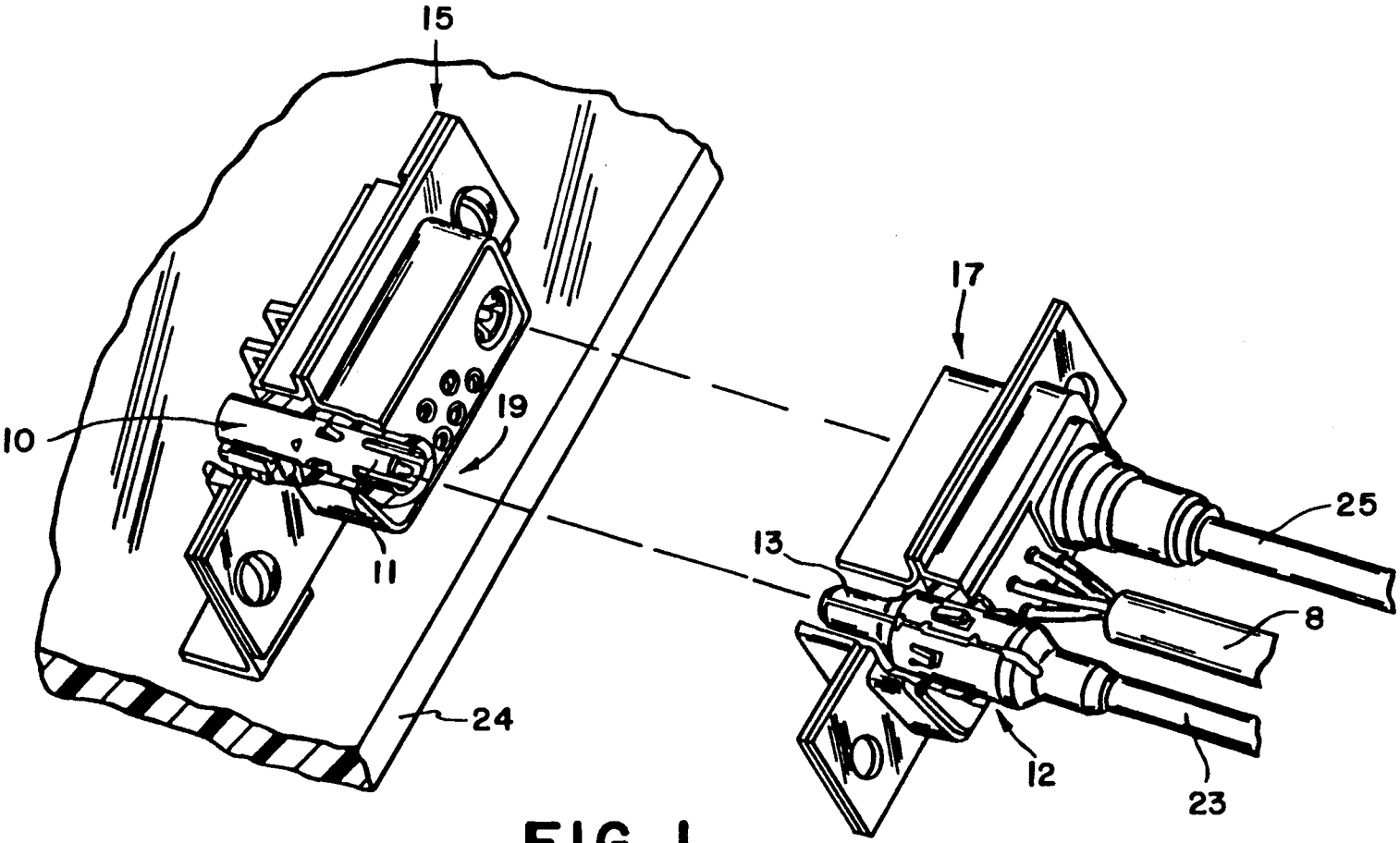
FIG. 1 is a perspective view, partially fragmented, illustrating a receptacle connector and a plug connector each of which is mounted in a combination connector housing.

A coaxial receptacle connector 10 and coaxial plug connector 12 constructed in accordance with the invention are shown in FIG. 1. The receptacle connector 10 has a receiver means 11 adapted to mate with a plug means 13 of the plug connector 12. The connectors 10 and 12 are illustrated as inserted in connector bores of combination housings 15 and 17, respectively. The combination housings 15, 17 are of the subminiature D category and include spaces for several of the coaxial connectors 10, 12 and conventional pin contacts 19. Only one configuration of combination connector, a conventional D subminiature, has been illustrated for ease of explanation of the invention. The connectors 10, 12 may, however, be used in any of the standard combination connector configurations including the DIN 41612 combination connector, D-microminiature combination connector, or even as stand alone connectors.

The combination housing 15 is affixed to a printed circuit board 24 while combination housing 17 electrically connects to coaxial cables 23 and 25 and multiple wire cable 8 having single conductor wires. The coaxial cable 23 is, therefore, connected to the printed circuit board 24 by mating the combination housings 15 and 17 together which, as a consequence, plugs the plug connector 12 into the receptacle connector 10.

Figure 2:
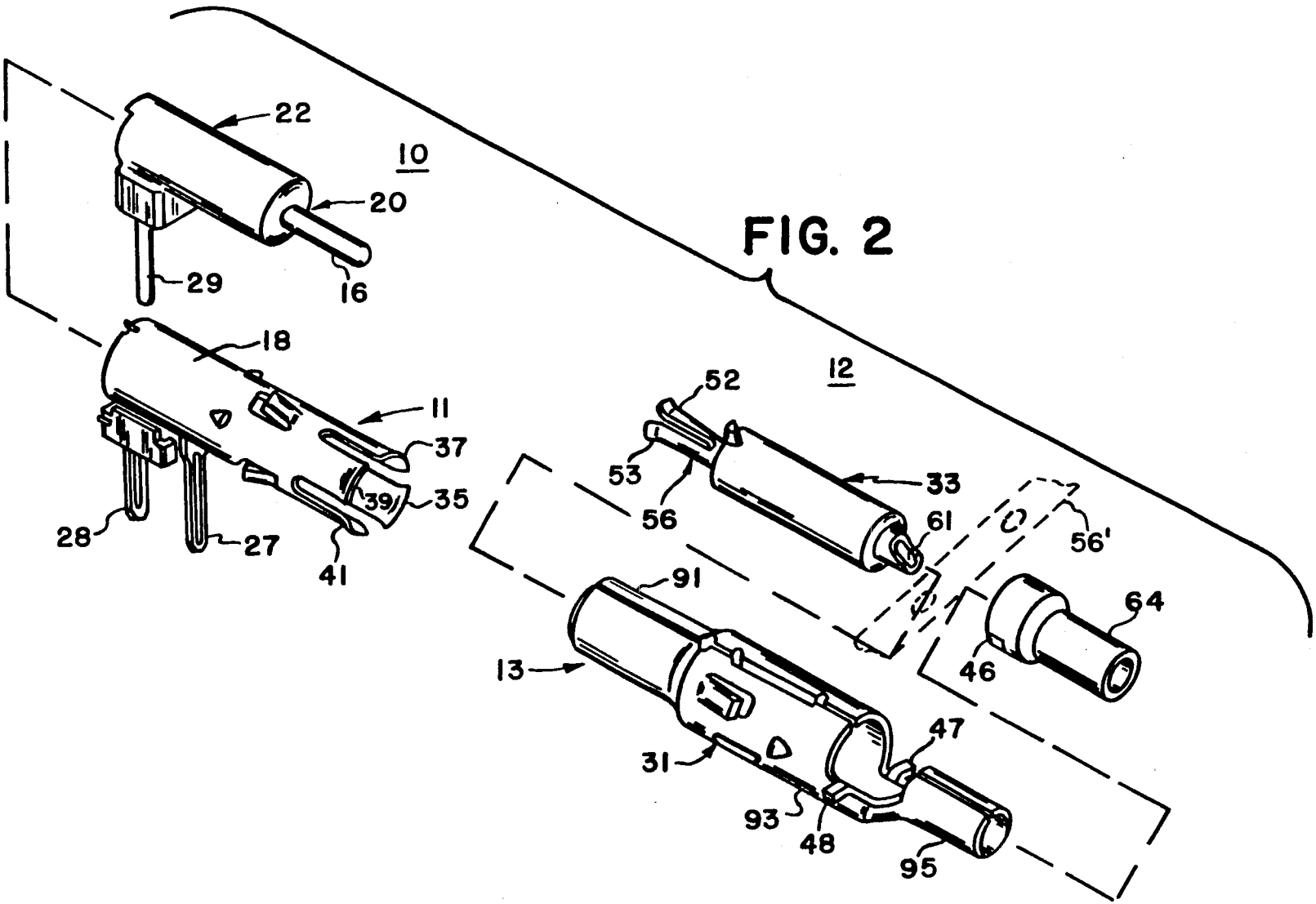
FIG. 2 is an exploded perspective view of the components of the receptacle connector and the plug connector illustrated in FIG. 1.
Figure 3:
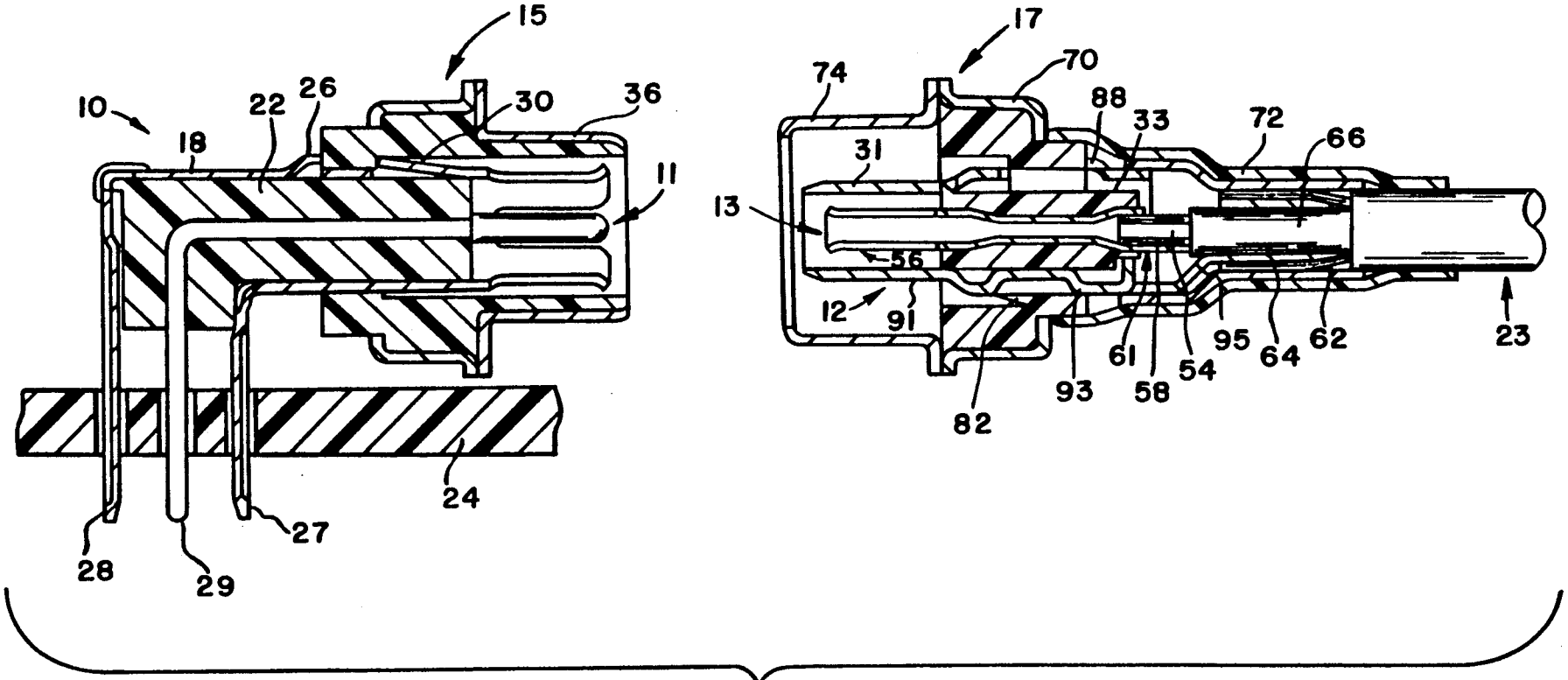
FIG. 3 is a cross-sectional view of the receptacle connector and the plug connector illustrated in FIG. 1.

Exploded and cross-sectional views of the receptacle connector 10 and the plug connector 12 are shown in FIGS. 2 and 3, respectively. With reference to FIG. 2, the receptacle connector 10 comprises an outer shell member 18, a dielectric member 22, and a center conductor member 20. As will be more fully explained hereinafter, the outer shell member 18 is metallic and is stamped and formed from a suitable strip of metal having a desirable spring characteristic and includes the receiver means 11 with four spring-like finger contacts 35, 37, 39 and 41, a tubular body section, and a terminal section right-angled to the body. A center conductor terminal 29 and front and rear terminal legs 27 and 28 of the terminal section are disposed within through holes of a printed circuit board 24 for solder connection. The terminal legs 27, 28 are soldered in a ground path and the conductor terminal 29 is soldered to a signal carrying conductor of the printed circuit board 24. The dielectric member 22 is molded from a suitable insulative and dielectric material, preferably Teflon or some other polyfluoro plastic, and retains the center conductor centered therein when it is molded. A contact or prong 16 of the center conductor 20 extends from the dielectric member 22 forming a signal conduction path for the receptacle connector in the receiver means 11. The conductor terminal 29 of the center conductor 20, the front terminal leg 27, and the rear terminal leg 28 form the terminal section for connection to the printed circuit board 24. The center conductor 20, shown as a screw machined loose part, can alternatively be stamped and formed from a preplated strip on a carrier. This alternative will reduce the cost of manufacture and allow selective plating, as well as provide a fabrication which is suitable to produce a leg for surface mounting.

The plug connector 12 similarly comprises an outer shell 31, a dielectric member 33, a center conductor 56, and ferrule 64. The outer shell 31 is metallic and is stamped and formed from a suitable metal sheet, similarly to the shell 18. The dielectric member 33 is molded from a suitable dielectric and insulative material, preferably Teflon. The center conductor 56 is stamped and formed on a carrier 56' and insert molded into the dielectric member 33 which retains it centered therein. The ferrule 64 is stamped and formed from a metallic sheet and provides a means for retaining the coaxial shield 62.

The center conductor 56 includes a fork-shaped receiver having tines 52, 53 and a solder cup 61. The outer shell 31 comprises a front tubular portion for contact with the contacts 35, 37, 39, 41 of the receptacle connector 10, a middle body portion 93 for generating a characteristic impedance for the connector in combination with the dielectric member 33, and a rear tubular portion 95 for connection to the coaxial cable 23. The middle body portion has ferrule tabs 47 and 48 which mate with slots 46 in the ferrule 64 to stop it at a predetermined position over the rear tubular portion 95.

As shown cross-sectionally in FIG. 3, the receptacle connector 10 is electrically mateable with the complimentary plug connector 12 when the combination housings 15, 17 are brought together. The receptacle connector 10 includes the center conductor 20 which electrically connects the center conductor 56 of the plug connector 12 to the printed circuit board 24. The center conductor 20 comprises a prong 16 with an elongated connection surface, a right-angled conductor body and a conductor terminal 29. The conductor terminal 29 and front and rear terminal legs 27 and 28 of the terminal section are disposed within through holes of the printed circuit board 24 for solder connection. The terminal legs 27, 28 are soldered in a ground path and the conductor terminal 29 is soldered to a signal carrying conductor of the printed circuit board 24.

The receptacle connector is mounted in the combination housing 15 which is counterbored. The shoulder of the first bore retains the outer shell 18 in the housing by latches 30 which spring outwardly against the shoulder. The latches 30 work in combination with stops 26 in the surface of the outer shell 18 and the shoulder of the counterbore to positively retain the connector 10 in place. The housing 15 is covered with a metallic shield which includes a front shield 36.

The plug connector 12 includes the center conductor 56 which electrically connects the signal conductor 54 of the coaxial cable 23 to the center conductor 20 of the receptacle connector 10. The center conductor 56 is generally tubular in shape and comprises at one end a solder cup 61 which receives the signal conductor 54 and solder 58, and at the other end, has a connection means including two fork-shaped resilient tines 52, 53 which flexibly receive the prong 16 of the center conductor 20. The center conductor 56 is mounted concentrically in a bore of the dielectric member 33 which is close fitted and stopped in the central chamber of the outer shell 31 by a stop 88.

The outer shell 31 comprises a front tube 91 which surrounds the center conductor 56 and is resiliently received in the contact fingers of the receptacle connector 10. The front tube 91 of the shell 31 is connected to a rear tube 95 by a middle body portion 93 which is substantially U-shaped in cross-section. The inner dielectric insulation 66 of the coaxial cable 23 is received in the rear tube 95 and the solder 58 applied to the center conductor 54 through the gap of the middle body portion. The braided shield 62 of the coaxial cable 23 is pulled over the rear tube 95 to electrically connect the outer shell 31 to the ground potential of the braided shield 62. The braided shield 62 is held in place on the rear tube by crimping the ferrule 64 around the tube.

The plug connector 12 is mounted in the housing 17 which is counterbored. The shoulder of the first bore retains the outer shell 31 in the housing 17 by latches 82 which spring outwardly against the shoulder. The latches work in combination with stops 88 in the surface of the outer shell 31 and the shoulder of the counter bore to positively retain the connector in place. The housing 17 is covered with a metallic shield which includes a front shield 74 which frictionally slips over the shield 36 of the housing 15 of the receptacle connector 10 and a rear shield 70. If desired, an insulative piece of shrink tubing 72 can be slipped over the plug connector 12 and the outer jacket of the coaxial cable 23.

When mated, the tines 52, 53 of the inner conductor 56 resiliently receive the prong 16 to electrically connect the signal conductor 54 of the coaxial cable 23 to the signal terminal of the printed circuit board 24 through center conductor 20. The front tube 91 of the shell 31 is resiliently held by spring contact fingers 35, 37, 39, 41 of the outer shell 18 to electrically connect the braided shield 62 of the coaxial cable 23 to the ground terminals of the printed circuit board 24 through shells 18 and 31. The ground shield 74 resiliently receives ground shield 36 to electrically connect the shield 74 of the plug connector !2 to the shield 36 of the receptacle connector 10.

Therefore, a coaxial receptacle connector 10 right angled to a printed circuit board terminal has been disclosed. The receptacle connector is readily mounted into and electrically connected to the signal and ground conductive paths of a printed circuit board and is electrically mateable with the coaxial plug connector 12 which terminates a coaxial cable. Further, a coaxial plug connector 12 which readily connects to the ground and signal paths of a coaxial cable has been disclosed. The coaxial plug connector 12 is electronically mateable with the receptacle connector 1? which connects at a printed circuit board 24.

FIGS. 4–15 illustrate specific features of the coaxial receptacle connector 10. In the bottom and side views of FIGS. 4 and 5 it is disclosed that the receptacle connector 10 includes a set of relieved portions with bent out latches 30, 32 and 34. These latches are spaced equally at 120 increments around the barrel of the body portion of the connector 10 to form the retaining means for the connector 10 in the combination housing 15. The body portion of the coaxial connector 10 further has a end cover 14, better seen in FIG. 6, which folds over the rear of the molded dielectric member 22 and a portion of which forms the rear terminal leg 28 of the terminal section. The foldable end cover 14 also contains a pair of side flaps 42, 43 which are bendable around the base of the molded dielectric member and which end in resilient tabs 44, 45, to positively retain the base of the dielectric member 22.

Figure 6:
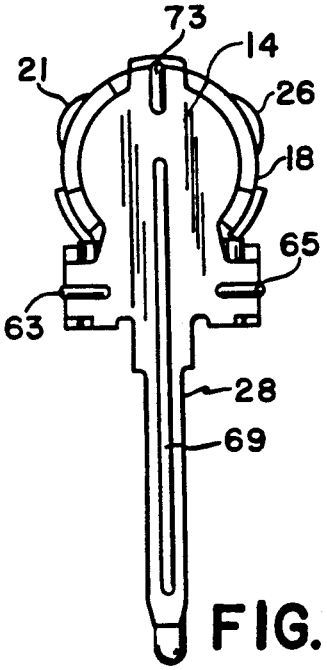
FIG. 6 is an end view of the receptacle connector taken along view lines 6—6 in FIG. 5.
Figure 7:
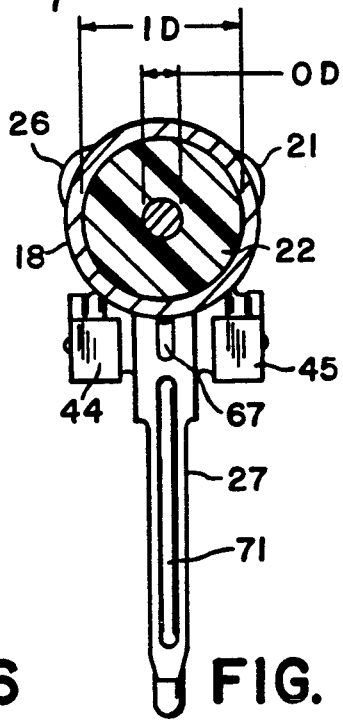
FIG. 7 is a cross-sectional front view of the receptacle connector taken along view lines 7—7 in FIG. 5.
Figure 8:
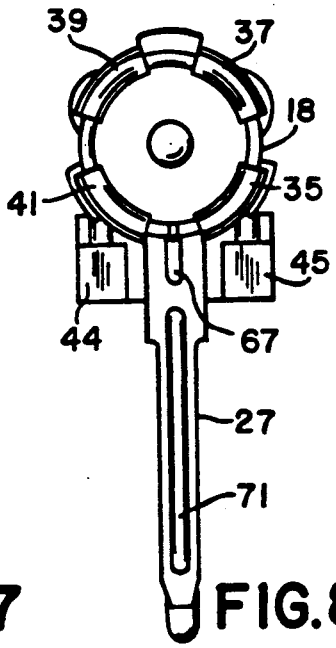
FIG. 8 is a front view of the receptacle connector taken along view lines 8—8 in FIG. 5.

As better illustrated in FIGS. 6–8, the bendable portions and terminal legs 27, 28 of the outer shell 18 are reinforced with ribs 63, 65, 67, 69, 71 and 73 to make them stiffer and easier to work with during the assembly process. The end cover 14 which is bent over the molded dielectric member 22 has a stiffener rib 73 at the bend. Both terminal legs 27, 28 have stiffener ribs 71 and 69, particularly shown in the end and cross-sectional views, which provide reinforcement for mounting in printed circuit boards. The bendable side flaps 42 and 43 are reinforced by ribs 63 and 65 at their bending portions. The front terminal leg 27 is additionally reinforced with a stiffener rib 67 where it is bent into place.

Figure 9:
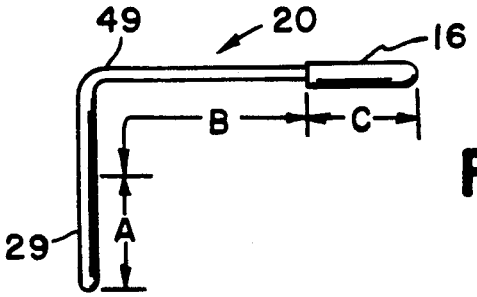
FIG. 9 is a side view of the center conductor for a receptacle connector having maximum impedance.
Figure 10:
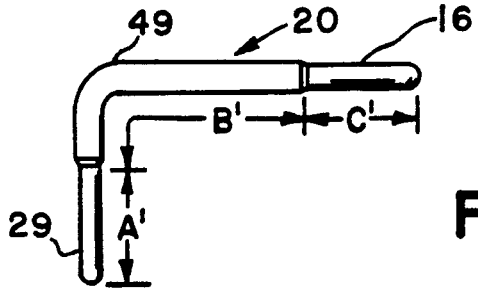
FIG. 10 is a side view of the center conductor for a receptacle connector having minimum impedance.
Figure 11:
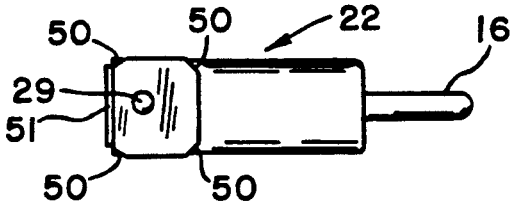
FIG. 11 is a bottom view of the dielectric member with a center conductor insert molded therein.
Figure 12:
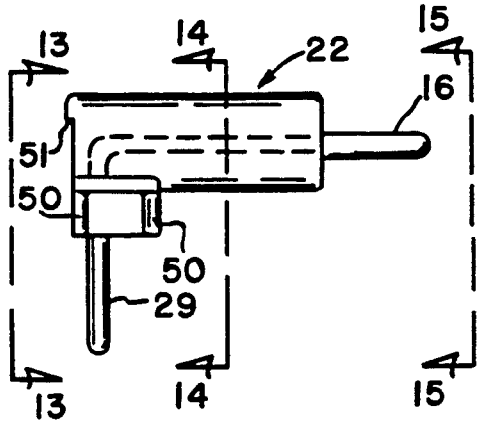
FIG. 12 is a side view of the dielectric member illustrated in FIG. 11.
Figure 13:
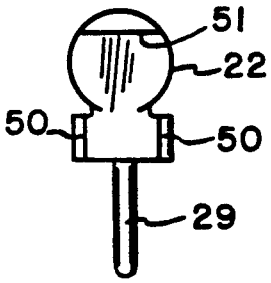
FIG. 13 is an end view of the dielectric member taken along view lines 13—13 in FIG. 12.
Figure 14:
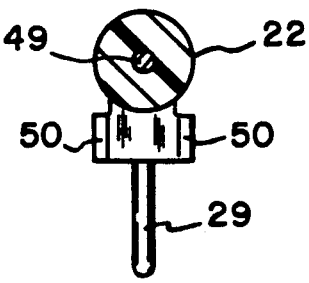
FIG. 14 is a cross-sectional front view of the dielectric member taken along view lines 14—14 in FIG. 12.
Figure 15:
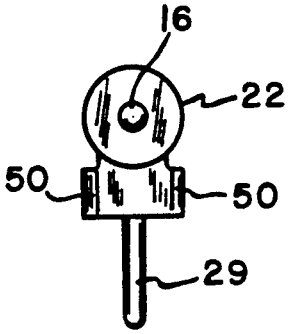
FIG. 15 is a front view of the dielectric member taken along view lines 15—15 in FIG. 12.

FIGS. 9–15 more clearly disclose the configuration and structure of the molded dielectric member 22 and center conductor 20. FIGS. 9 and 10 illustrate the configurations available for the center conductor 20. The center conductor 20 of FIG. 9 comprises three parts including a standard sized contact 16 of length C, a conductor body 49 of length B, and a standard sized conductor terminal 29 of length A. The center conductor 20 of FIG. 10 has corresponding parts 16 of length C', 49 of length B', and 29 of length A', where A=A', B=B', and C=C'. The difference between the two is the variation in the diameter of the conductor bodies 49. The center conductor 20 preferably is stamped and formed on a carrier into a straight pin which produces the conductor body 49 with a range of outside diameters to exhibit a particular impedance which matches with a specifically sized coaxial cable. The stamped and formed center conductor 20 is lower in cost to manufacture, can be selectively plated or even preplated on a strip, and is easily automated. FIG. 9 illustrates the minimum size for the larger (or higher) impedance and FIG. 10 illustrates the maximum size for the lower impedance. The prong 16 of both embodiments is of a specified diameter to mate with the standard contact means of the plug connector 12. A third diameter is used for the conductor terminal 29 and is sized for a conventional through hole of the printed circuit board 24.

After being formed, the center conductor 20 is bent at a right angle and then inserted into a mold for forming the dielectric member 22. A standard molding process using injection grade Teflon is used to make the dielectric member 22. The dielectric member 22 consists of a body which is generally cylindrically shaped and mounted on a base through relieved portions. The dielectric member 22 is also provided with a relieved back portion 51 to improve the formability of the rear terminal leg 28 of the outer shell 18. The base of the dielectric member 22 is generally rectangular and includes fillet portions 50 which assist in the bending of the shell around the member 22 during the formation process.

An equation for determining the impedance of a coaxial receptacle connector of this configuration is given by:

$$Z = \frac{C_1}{\sqrt{E_r}} \log\left(\frac{ID_r}{OD_r}\right)$$

where Z=the impedance of the receptacle connector 10 in ohms;

$C_1$=138, a constant $E_r$=dielectric constant of member 22, (Teflon=2.03);

$ID_r$=inner diameter of receptacle shell 18 in inches; and $OD_r$=outer diameter of the middle body portion 49 of the receptacle center conductor 20 in inches.

For an exemplary receptacle connector 10 with a precision impedance of 75 ohms, the inner diameter of the outer shell 18 would be 0.1575 inches and the outer diameter of the middle body portion of the center conductor would be 0.026 inches. This produces a high impedance connector which is suitable for the new uses of coaxial connectors in the computer and telecommunications industries. It is evident that even higher impedance connectors are possible because the molding process makes the use of very small center conductors feasible.

Moreover, because of the stamping, forming, and molding operations of the invention, these dimensional values can be held to precise tolerances. These processes controlled to produce tolerances within ±0.001 of an inch which yields precision impedance matching within ±0.035 ohms for the 75 ohm connector described.

Figure 16:
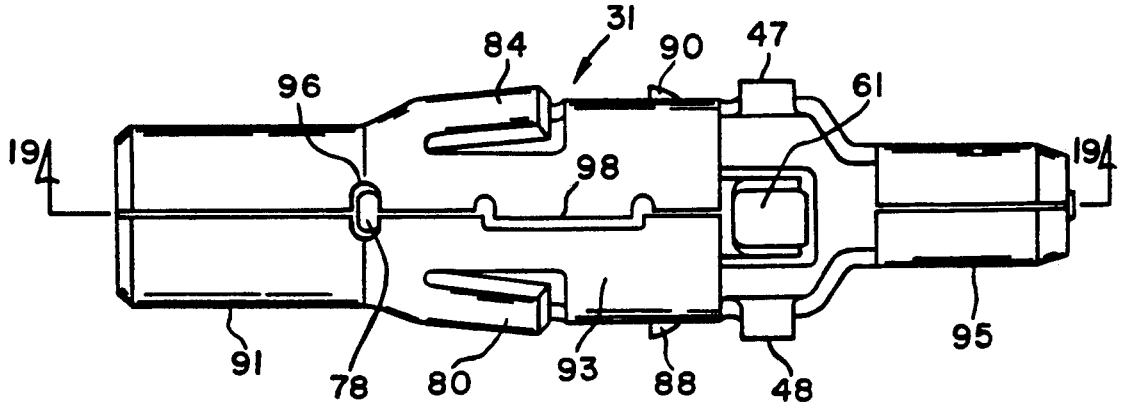
FIG. 16 is a top view of the plug connector illustrated in FIG. 1.
Figure 17:
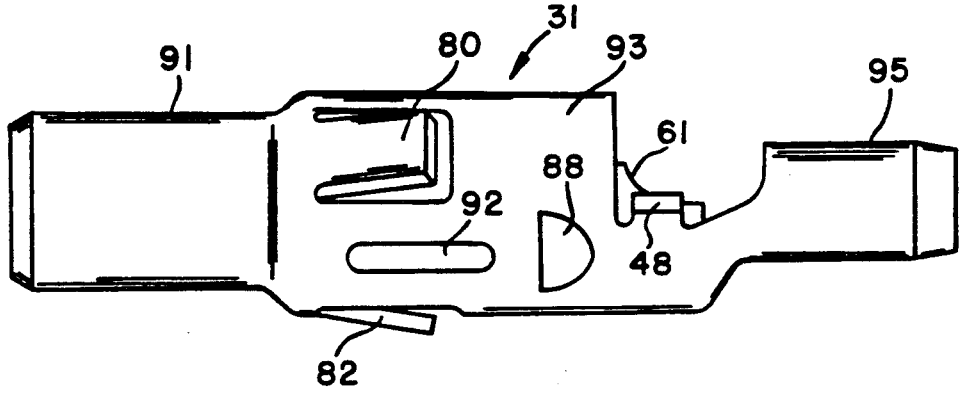
FIG. 17 is a side view of the plug connector illustrated in FIG. 1.

The specific features of the plug connector 12 are more clearly shown in FIGS. 16–27. FIGS. 16, 17, and which illustrate top, side, and bottom views of the plug connector 12, respectively disclose the outer shell 31 of the plug connector 12 is folded around the inner dielectric member 33 (FIG. 19) which contains the center conductor 56. The outer shell 31 comprises the front tubular member 91 which is connected to the rear tubular member 95 by the central cup shaped body member 93. The front tubular member 91 necks down to become the plug means 13 which is received into the receiver means of the receptacle connector 10. The rear tubular member 95 accepts the inner insulator 66 of the coaxial cable 23 (FIG. 3) to provide strain relief while the body member 93 provides access to the solder cup 61 of the center conductor 56 such that the signal conductor of the coaxial cable 23 may be soldered thereto. The outer shell 31 includes three spring latches 80, 82, and 84 spaced at 120° increments around the periphery of the front tubular member 91. Designed to act in concert with the latches 80, 82, and 84 are two cowl shaped stops 88 and 90 each located between two of the latches. The latches and stops locate and retain the plug connector 12 centered in the contact bore of the combination housing 17.

Figure 18:
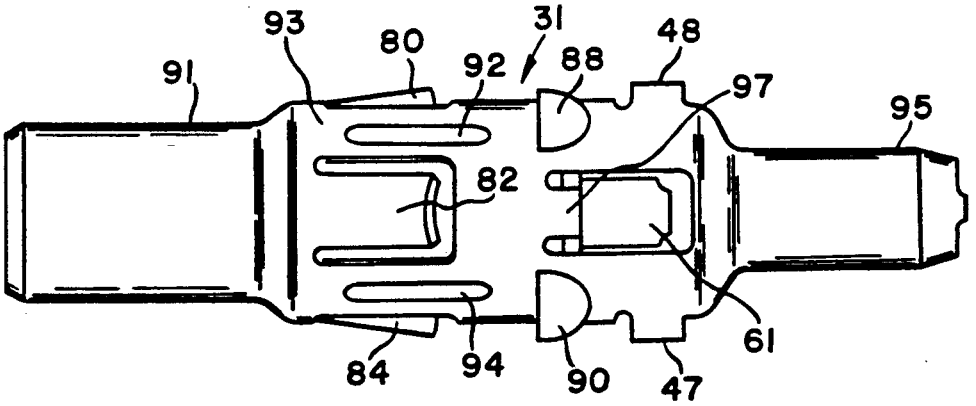
FIG. 18 is a bottom view of the plug connector illustrated in FIG. 1.
Figure 19:
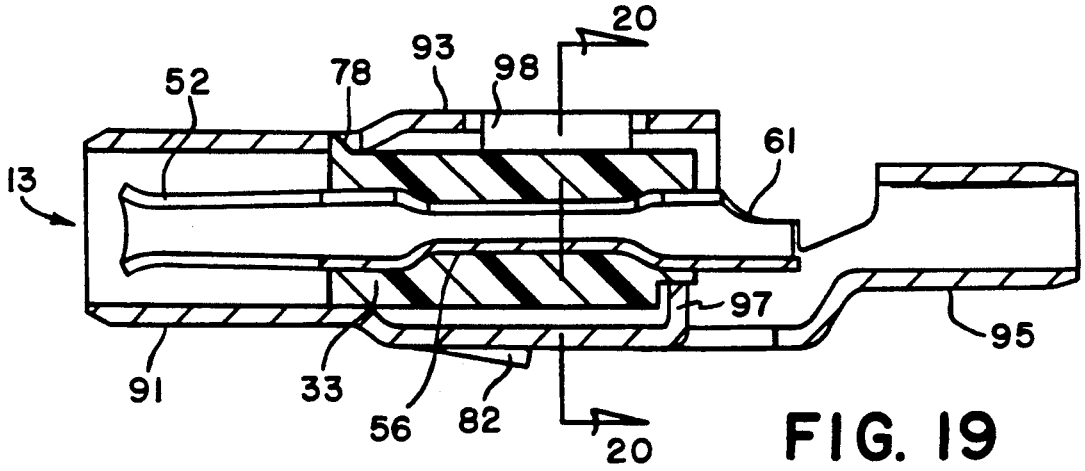
FIG. 19 is a cross-sectional side view of the plug connector taken along view lines 19—19 in FIG. 16.
Figure 20:
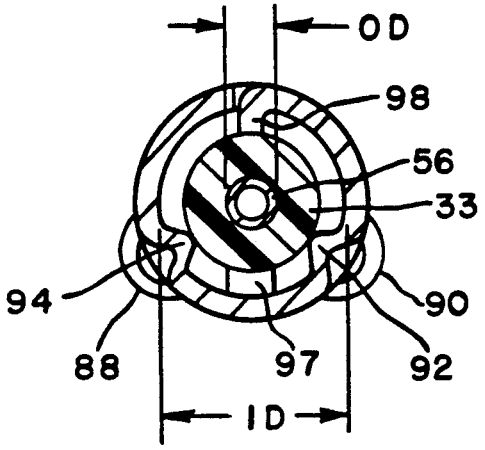
FIG. 20 is a cross-sectional front view of the plug connector taken along view lines 20—20 in FIG. 19.

FIG. 19 and FIG. 20, which are cross-sectional views of the plug connector illustrated in FIGS. 16–18, more clearly disclose that the dielectric member 33 and center conductor 56 combination are supported by the spacing means such that the inner surface of the front tubular portion 91 and the outer surface of the dielectric member 33 define a generally annular air space about the dielectric member 33. The spacing means, including indents 92, 94 and a spacing tab 98, form means which are elongated along the central axis of the dielectric member 33 in equal angular increments. The dielectric 33 is stopped in a forward manner by a horn 78 and in a rearward manner by a retaining tab 97 which is bent upwardly.

FIGS. 21 and 22 show a top and a cross-sectional side view, respectively of the center conductor 56 of the plug connector 12. The center conductor 56, which may be stamped from a flat metallic sheet and formed on a carrier 56' into the configuration illustrated, includes a front fork-shaped connecting means having the two resilient tines 52,53, a generally cylindrical conductor body 60 and a solder cup 61. The connecting means is generally of a standard configuration and size for receiving the prong 16 of the receptacle connector 10. The solder cup 61 is generally of a standard configuration and size for receiving the signal conductor of a coaxial cable of a predetermined impedance. The diameter of the connector body is used to vary the impedance of the connector by having a selectable outside diameter connecting the two standard end pieces of the center conductor 56.

The impedance of the plug connector 12 is given by the equation:

$$Z = \frac{C_2}{\sqrt{E_c}} \log\left(\frac{ID_p}{OD_p}\right)$$

where Z=impedance of the plug connector in ohms;
$C_2$=138, a constant;
$E_c$=the combined dielectric constant of air and dielectric member 33;
$ID_p$=inner diameter of the plug shell in inches; and
$OD_p$=outer diameter of the middle body portion 60 of the plug center conductor 56 in inches.

For an exemplary plug connector 12 with a precision impedance of 75 ohms, the inner diameter of the outer shell 31 would be 0.1575 inches and the outer diameter of the middle body portion of the center conductor 56 would depend upon the combined dielectric constant $E_c$. If no air gap is used, the outer diameter would be the same as that of the receptacle connector, 0.026 inches. However, the air gap allows a larger outer diameter to be used and that portion of the center conductor 56 can be expanded to 0.032 inches when a dielectric member 33 having an outside diameter of 0.123 inches is used, i.e., an air gap of 0.0345 inches.

Moreover, because of the stamping, forming, and molding operations of the invention, these values can be held to precise tolerances. These processes can be controlled to produce tolerances within ±0.001 of an inch which yields precision impedance matching within ±0.035 ohms for the 75 ohm connector described.

In FIGS. 23 and 24, the center conductor 56 on a carrier 56' is shown insert molded into the dielectric member 33 which is generally cylindrical in shape but which includes two locating means, including a horn 78 for front positioning and a notch 57 cut in the rear of the dielectric member for rearward positioning. FIG. 25 is a front view taken along view lines 25—25 of FIG. 24 illustrating the projection of the connecting means from the cylindrical dielectric member 33. FIG. 26 is a cross-sectional view taken along view lines 26—26 of FIG. 24 illustrating the cylindrical relationship of the conductor body 60 and dielectric member 33 at the point which contributes to the generalized impedance equation. FIG. 27 illustrates a rear view of the connector taken along lines 27—27 of FIG. 24 illustrating the solder cup 61 and retention notch 57 of the dielectric member 33.

Figure 28:
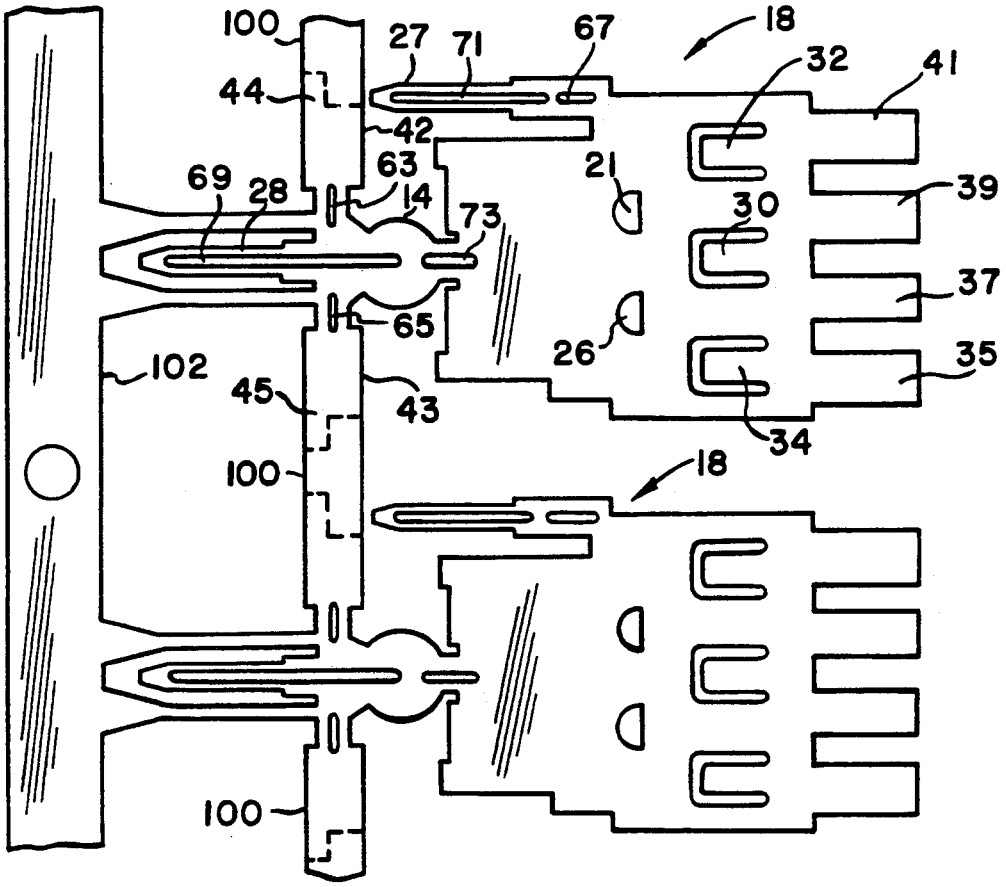
FIG. 28 is a plan view of one section of a blank stamped to form the outer shell of the receptacle connector.

FIGS. 28-35 will now be more fully explained to disclose a preferred assembly process for the receptacle connector 10. The outer shell 18 for each receptacle connector is stamped from a metal sheet as shown in FIG. 28. A multiplicity of blanks forming the initial shape of the outer shell can be attached to a center carrier 100 and a rear carrier 102 for easier handling during the production process. Initially, a blank is cut in a generally rectangular shape having projections for the contact fingers 35, 37, 39, and 41 and C-shaped cut-outs for the latches 30, 32, and 34. The cowl shaped stops 26 and 21 are formed during this period by raised projections in the stamping die (not shown). The carriers 100, 102 are attached to the blanks at the tail portion of the outer shell which has the circular end cover 14 attached to a T shaped tail. The center carrier 100 will be used to form the side flaps 42, 43 and the end tabs 44, 45 of the outer shell and the center of the tail will be used to form the rear terminal leg 28. Ribs 67, 71 of the front terminal leg 27 and rib 69 of the rear terminal leg 28, respectively, and ribs 63, 65 and 73 of the side flaps 42, 43 and tail portion 14, respectively are formed at this time by raised projections in the stamping die.

Figure 29:
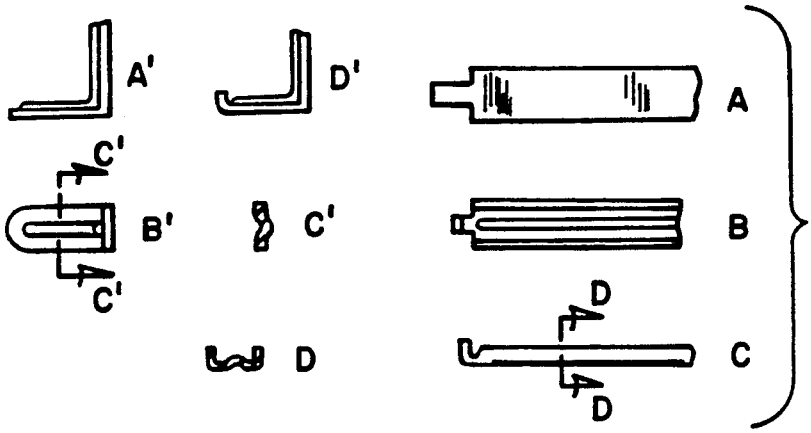
FIG. 29 is a fragmented portion of FIG. 28 illustrating several surface mounting terminal legs.
Figure 30:
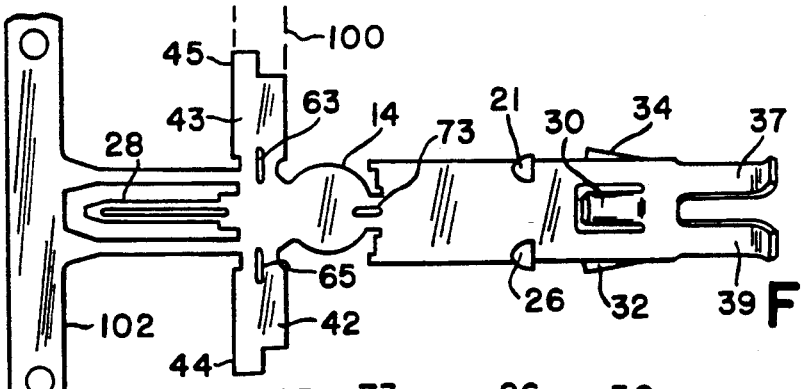
FIGS. 30-34 are pictorial representations of various stages of the assembly process for the receptacle connector illustrated in FIG. 1.

To this point, the terminal legs 27, 28 and conductor terminal 29 have been described as applicable to mounting in the through holes of a printed circuit board 24. In FIG. 29 there are disclosed terminal legs and conductor terminals which are adapted for surface mounting on printed circuit boards. For surface mounted components, the printed circuit board will have component pads rather than through holes. The center conductor and outside shell of the receptacle connector are stamped and formed, which processes lend themselves readily to the formation of the most popular types of surface mounting terminal configurations. The most typical shapes used in low voltage, UHF/VHF signal connectors are the gull-wing, the J-bend, and the L-wing. All of these shapes are easily made as shown in FIGS. 29A-D, 29A'-29D' by the stamping and forming operations.

Figure 35:
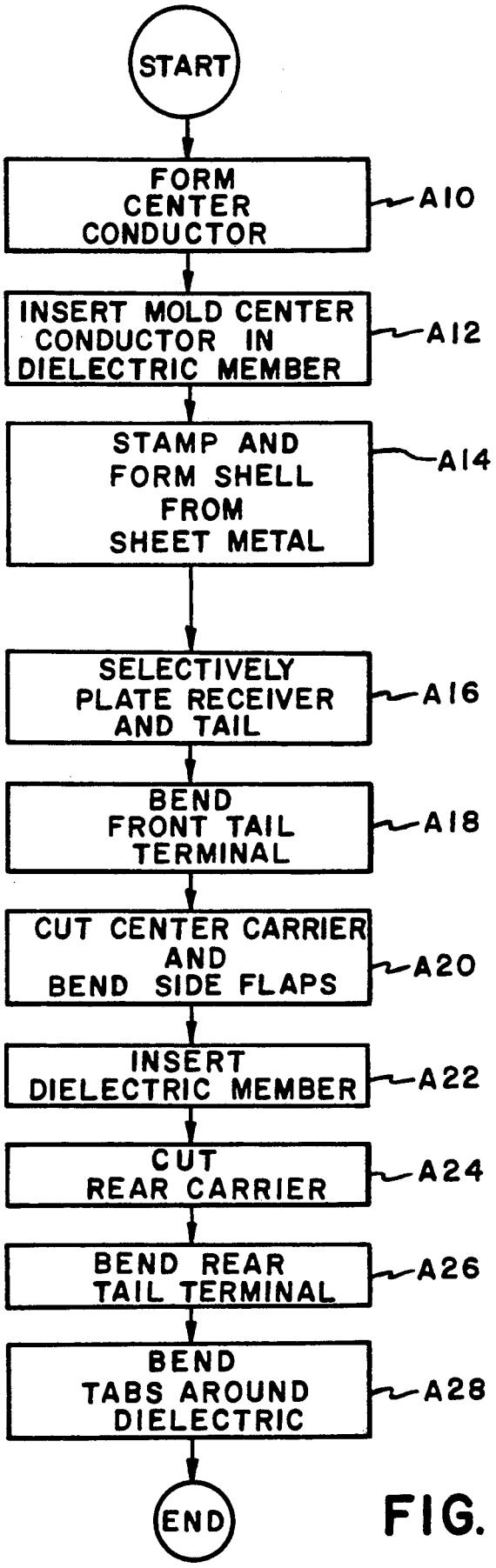
FIG. 35 is a process flow chart describing the various steps of assembly illustrated in FIGS. 30-34.

The process for assembling the receptacle connector 10 begins in block A10 of FIG. 35 by forming the center conductor 20. Preferably, the center conductor 20 is stamped on a carrier with the desired proportions for the body, the terminal portion and the front prong. Next in block A12, the center conductor 20 is insert molded into the dielectric member 33. The dielectric member 33 and insert molded center conductor 20 are then set aside until a later step in the assembly process.

The outer shell 18 is then stamped and formed from a blank of metallic sheet metal in block A14. The stamping is accomplished in several steps. The final shape of the stamping which appears in FIG. 30. After the receiver portion has been formed and while the receptacle connector 10 is still attached to the center carrier 100 and rear carrier 102, each end may selectively be plated. Preferably, in the plating process which occurs in block A16, the receiver means 11 is plated with a noble metal such as gold, silver, etc. to provide excellent conductivity to the contact fingers, and the terminal section is selectively plated or tinned to receive solder.

Figure 31:
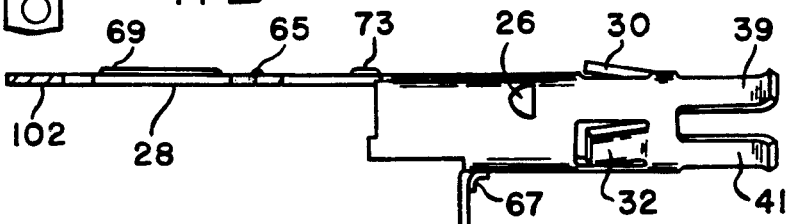
Figure 32:
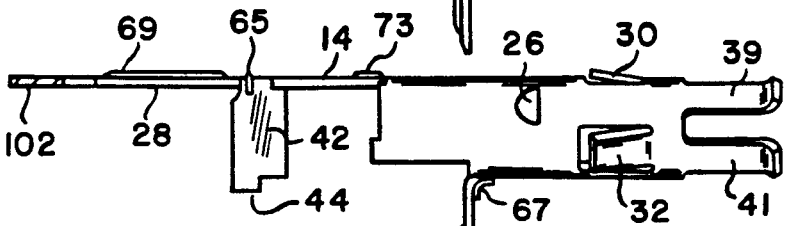
Figure 33:
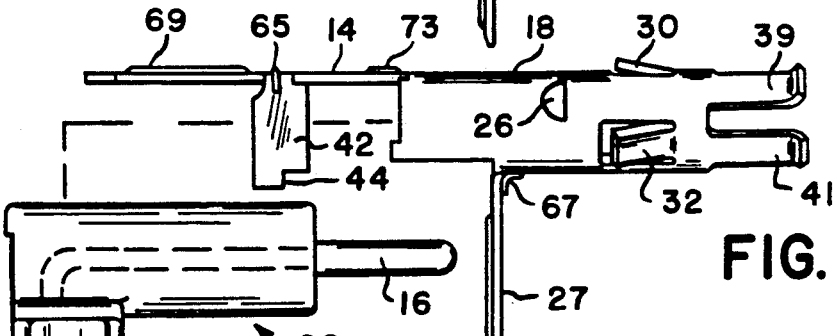
Figure 34:
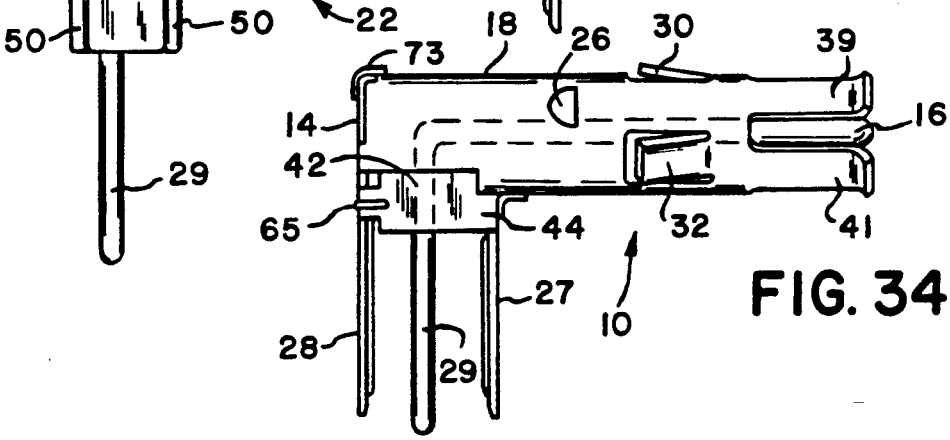

When the portions have been plated, the front terminal leg 27 is bent in block A18 which produces the outer shell shape illustrated in FIG. 31. Subsequently, the center carrier 100 is cut, and the side flaps 42, 43 are bent 90° in block A20 to form the shape illustrated in FIG. 32. The barrel of the receptacle connector 10 then receives the dielectric member and center conductor combination in block A22 from the rear as illustrated in FIG. 33. Once the dielectric member 33 and center conductor 20 have been inserted in the barrel, the rear carrier 102 is cut in block A24. The end cover 14 is bent down around the dielectric member 22 which positions the rear terminal leg 28 at 90° to the axis of the barrel in block A26. The final step in the assembly method is to bend the retaining tabs 44, 45 around the front of the base of the dielectric member 22 in block A28. The finished assembled receptacle connector is illustrated in FIG. 34.

Figure 36:
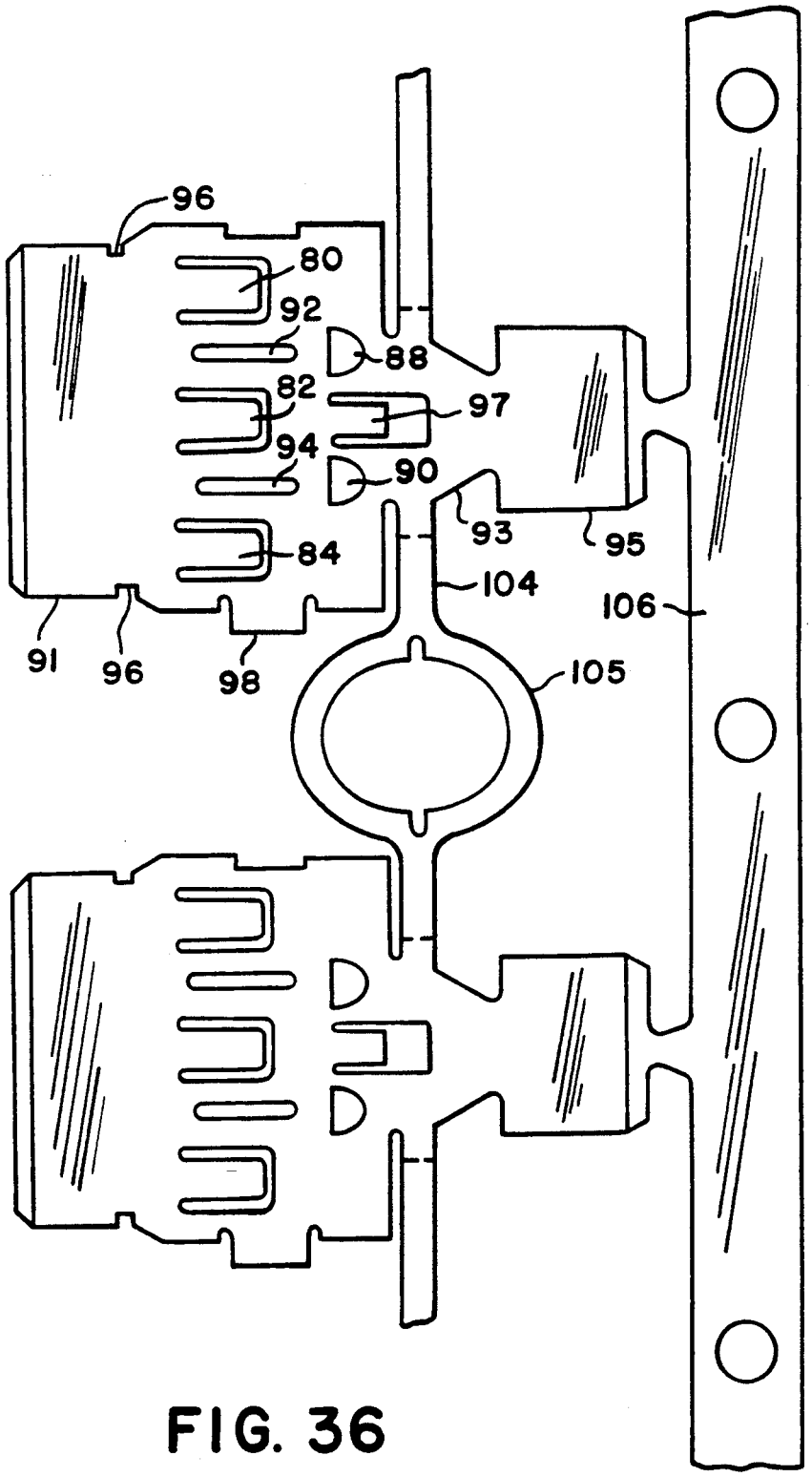
FIG. 36 is a plan view of one section of a blank stamped to form the outer shell of the plug connector.
Figure 38:
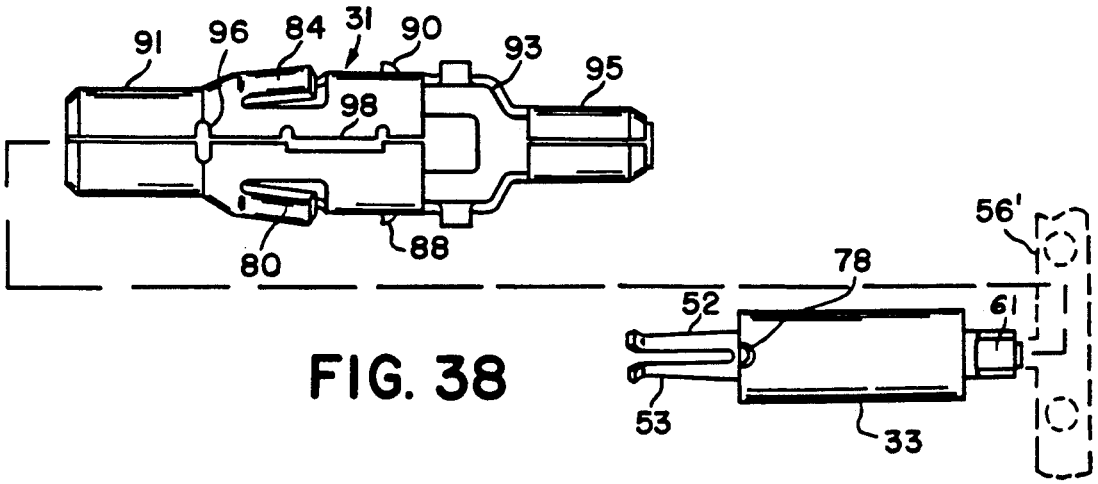
Figure 39:
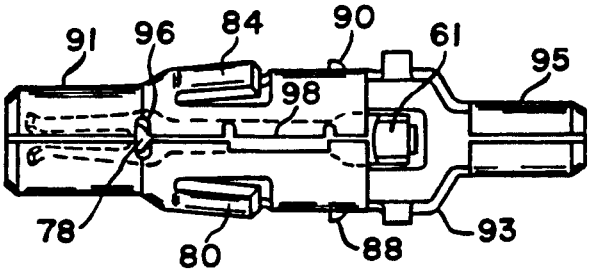
Figure 40:
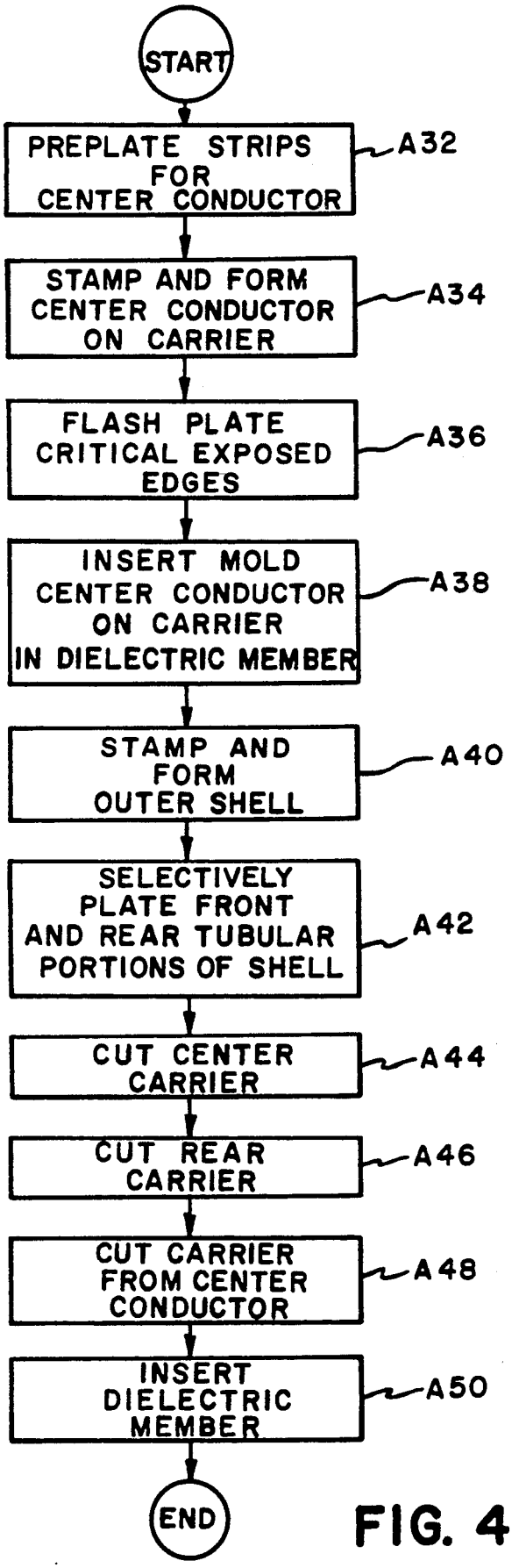
FIG. 40 is a process flow chart describing the various steps of assembly illustrated in FIGS. 37-39.

FIGS. 36–40 illustrate a process similar to that described for the receptacle connector 10 for assembling the plug connector 12. FIG. 40 is a detailed process flow chart of the process and FIGS. 36–39 show various intermediate steps in the process. The outer shell 31 for each plug connector is stamped from a generally rectangular metallic blank as shown in FIG. 36. A multiplicity of blanks forming the initial shape of the outer shell can be attached to a center carrier 104 and a rear carrier 106 for easier handling during the production process. Initially, the blank is cut in the generally rectangular shape including portions for the front tube 91, the center body cup 93 and the rear tube 95. The center carrier 104 connects the adjacent center body cups 93 of the outer shells 31 with carrier material. The rear tube 95 of each outer shell 31 connects to the rear carrier 106 by a flashing. The spring latches 80, 82, and 84 and retaining tab 97 are formed in the blanks by C-shaped cutouts in the stamping die (not shown). The cowl shaped stops 88 and 90 are formed by raised projections on the stamping die while the indents 92 and 94 are formed by raised projections on the opposite die face.

The assembly process begins in block A32 by preplating a conductive stripe on the front and tail end of the center conductor strip. This provides tinning for the solder cup 61 at one end of the center conductor 56, and a conductive plating for the inner tines 52, 53 of the center conductor at the other end. Next, the center conductor 56 is formed in block A34 by shaping the stamped blank into the center conductor on a carrier 56' illustrated in FIG. 21. The next step is to flash plate the exposed connector end in block A36. The finished center conductor 56 is inserted into a mold (not shown) for forming the dielectric member 33 and the molding process is accomplished in block A38. The center conductor 56 and dielectric member 33 combination may then be set aside while the outer shell 31 of the plug connector 12 is formed.

Figure 37:
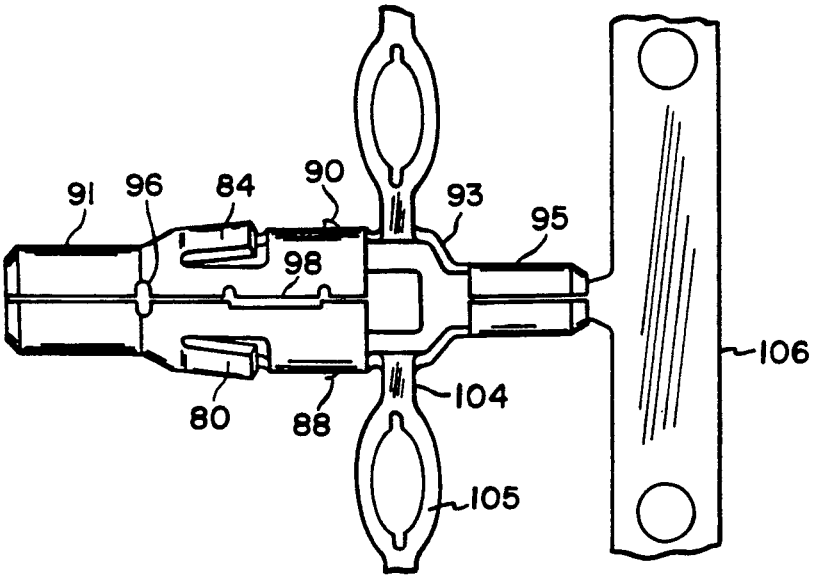
FIG. 37-39 are pictorial representations of various stages of the assembly process for the plug connector illustrated in FIG. 1.

The outer shell 31 is initially stamped and formed from a blank in block A40 in the shape shown in FIG. 37. The blanks of each outer shell 31 are connected by a center carrier 104 and a rear carrier 106. These carriers are used in block A40 to help form the tubular shape of the shell 31. When the center cup 93 is formed, the circular portions 105 of the center carrier 104 deform to allow the cup to take shape as illustrated in FIG. 37. The front and rear tubular sections 91, 95 of the outer shell 31 are then selectively plated in block A42 with gold for the front tube and tinning composition for the rear tube. The center and rear carriers 104, 106 are then cut in blocks A44 and A46 to separate the individual outer shells 31.

Thereafter, in block A48 the insulator carrier 56' can be cut and in block A50, the dielectric member 33 inserted into the outer shell 31 as illustrated in FIG. 38. The dielectric member 33 is then inserted from the front of the outer shell 31. The fully assembled plug connector 12 is illustrated in FIG. 39.

The manufacturing processes described for the receptacle connector 10 and the plug connector 12 are advantageous for several reasons. As explained earlier, the insert molding of the center conductors permits a convenient method of varying of impedance ratings of the connectors without changing the mold specifications or the stamping dies. The processes described herein lend themselves to forming precise diameters and thus the impedance ratings may be varied not only over a wide range but also within close tolerances so that very low VSWRs may be obtained with UHF and VHF coaxial cable connections. The ability to insert mold very small diameters for the center conductors enhances the ability to increase the impedance of these connectors to 75 ohms, or greater, without affecting the outside configuration of the shell.

The stamping, forming, and molding processes also allow a miniaturization of the connectors for a grid size of 0.050 in.×0.050 in., or smaller, for a D-microminiature housing with macrominiature coaxial contacts. This miniaturization can be accomplished by scaling down sizes and thicknesses without significant changes in the design or assembling process. Thus, greater densities to the macrominiature level can be achieved while retaining the advantages of the low cost assembly and production processes. The macrominiature size can also be rated at 75 ohms, or greater, to operate at the GHz level with precise impedance matching.

Additionally, because there are only two basic parts (the shell and dielectric member) to assemble, the assembly process is reduced in cost and can be highly automated. The stamping processes are well suited to automation because the carriers allow multiple pieces to be handled simultaneously and provide spacing and location information for the assembling machinery. All of these advantages permit a superior connector to be produced at a reduced manufacturing expense.

While the preferred embodiments of the invention have been shown and described in detail, it will be obvious to those skilled in the art that various modifications and changes may be made thereto without departing from the spirit and scope of the invention as is defined in the appended claims.

What is claimed is:

1. A method for assembling a coaxial connector comprising the steps of:

providing a center conductor;

inserting said center conductor into a mold;

molding a dielectric member of a predetermined form around said center conductor;

stamping and forming an outer shell into a mating shape with the form of said dielectric member; and inserting said molded dielectric member and said center conductor into said formed outer shell.

2. A method for assembling a coaxial connector as set forth in claim 1 wherein said step of providing said center conductor includes:

bending at least a portion of said center conductor at an angle of substantially 90° before said molding step.

3. A method for assembling a coaxial connector as set forth in claim 1 wherein said step of forming said outer shell includes the steps of:

forming said outer shell with a tubular shaped body portion with an inner surface of constant diameter.

4. A method for assembling a coaxial connector as set forth in claim 3 wherein said step of providing said center conductor includes:

forming said center conductor with an outer surface of variable diameter such that the impedance of the connector varies.

5. A method for assembling a coaxial connector as set forth in claim 1 wherein the step of forming said outer shell includes the step of:

forming a bendable tail portion attached to a portion having a bendable flap extending from each side which ends in a bendable tab.

6. A method for assembling a coaxial connector as set forth in claim 5 which further includes the steps of:

forming said outer shell with a tubular shaped body portion;

forming said dielectric member with a tubular shaped body portion and a base portion;

inserting said tubular body portion of said dielectric member into said tubular portion of said outer shell; and bending said tail portion of said shell over said base portion of said dielectric member.

7. A method of assembling a coaxial connector as set forth in claim 6 which further includes:

bending said side flaps around the outer edges of the base of said dielectric member and locking said retaining tabs over around an edge.

8. A method of assembling a coaxial connector as set forth in claim 6 wherein said step of forming an outer shell includes the steps of:

forming a bendable terminal leg.

9. A method of assembling a coaxial connector as set forth in claim 8 further including the step of:

bending the terminal leg at a right angle to said tubular body.

10. A method for assembling a coaxial connector as set forth in claim 1 wherein the steps of forming said outer shell includes the step of:

forming said outer shell on a carrier with a front tubular portion, a body portion with an inner surface of constant diameter, and a rear tubular portion.

11. A method for assembling a coaxial connector as set forth in claim 10 wherein the step of providing said center conductor includes the steps of:

forming said center conductor on a carrier with a fork-shaped receiver, a connector body, and a solder cup.

12. A method for assembling a coaxial connector as set forth in claim 1 wherein the step of stamping and forming an outer shell includes:

forming said outer shell on a carrier.

13. A method for assembling a coaxial connector as set forth in claim 12 wherein the step of forming said outer shell on a carrier includes:

selectively plating said outer shell.

14. A method for assembling a coaxial connector as set forth in claim 1 wherein the step of providing a center conductor includes:

providing a stamped and formed center conductor on a carrier.

15. A method for assembling a coaxial connector as set forth in claim 14 wherein said step of providing a stamped and formed center conductor on a carrier further includes:

selectively preplating said center conductor.

16. A method for assembling a coaxial connector comprising the steps of:

stamping and forming a center conductor including forming said center conductor with an outer surface of variable diameter such that the impedance of the connector varies;

inserting said formed center conductor into a mold;

molding a formed dielectric member around said center conductor;

stamping and forming an outer shell into a mating shape with said formed dielectric member, including forming said outer shell with a tubular shaped body portion with an inner surface of constant diameter; and inserting said molded dielectric member and said center conductor into said formed outer shell.

17. A method for assembling a coaxial connector comprising the steps of:

stamping and forming a center conductor;

stamping and forming an outer shell including forming a bendable tail portion attached to a body portion having a bendable flap extending from each side which ends in a bendable tab;

inserting said formed center conductor into a mold;

molding a formed dielectric member around said center conductor; and forming said outer shell into a mating shape with said formed dielectric member.

18. A method for assembling a coaxial connector as set forth in claim 17 which further includes the steps of:

forming said outer shell with a tubular shaped body portion;

forming said dielectric member with a tubular shaped body portion and a base portion;

inserting said tubular body portion of said dielectric member into said tubular portion of said outer shell; and bending said tail portion of said shell over said base portion of said dielectric member.

19. A method of assembling a coaxial connector as set forth in claim 18 which further includes:

bending said side flaps around the outer edges of said base portion of said dielectric member and locking said retaining tabs around an edge.

20. A method of assembling a coaxial connector as set forth in claim 18 wherein said step of forming an outer shell includes the step of:

forming a bendable terminal leg.

21. A method of assembling a coaxial connector as set forth in claim 20 further including the step of:

bending the terminal leg at a right angle to said tubular body.

22. A method for assembling a coaxial connector comprising the steps of:

stamping and forming a center conductor;

inserting said formed center conductor into a mold;

molding a formed dielectric member around said center conductor; and stamping and forming an outer shell into a mating shape with said formed dielectric member, including forming said outer shell on a carrier with a front tubular portion, a body portion with an inner surface of constant diameter, and a rear tubular portion.

23. A method for assembling a coaxial connector as set forth in claim 22 wherein the step of forming said center conductor includes the step of:

forming said center conductor on a carrier with a fork-shaped receiver, a connector body, and a solder cup.

24. A method for assembling a coaxial connector as set forth in claim 23 which further includes the step of:

inserting said formed dielectric member and said center conductor into said formed outer shell.

* * * * *

UNITED STATES PATENT AND TRADEMARK OFFICE

CERTIFICATE OF CORRECTION

PATENT NO. : 5,060,373

DATED : October 29, 1991

INVENTOR(S) : Machura, et al.

It is certified that error appears in the above-identified patent and that said Letters Patent is hereby corrected as shown below:

Column 2, line 4, "coaxial should" should read --coaxial connection to a local area network or a telephone line should--.

Figure 4:
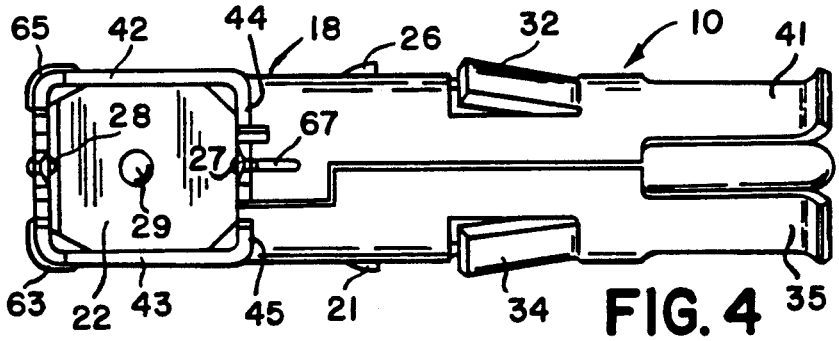
FIG. 4 is a bottom view of the receptacle connector illustrated in FIG. 1.
Figure 5:
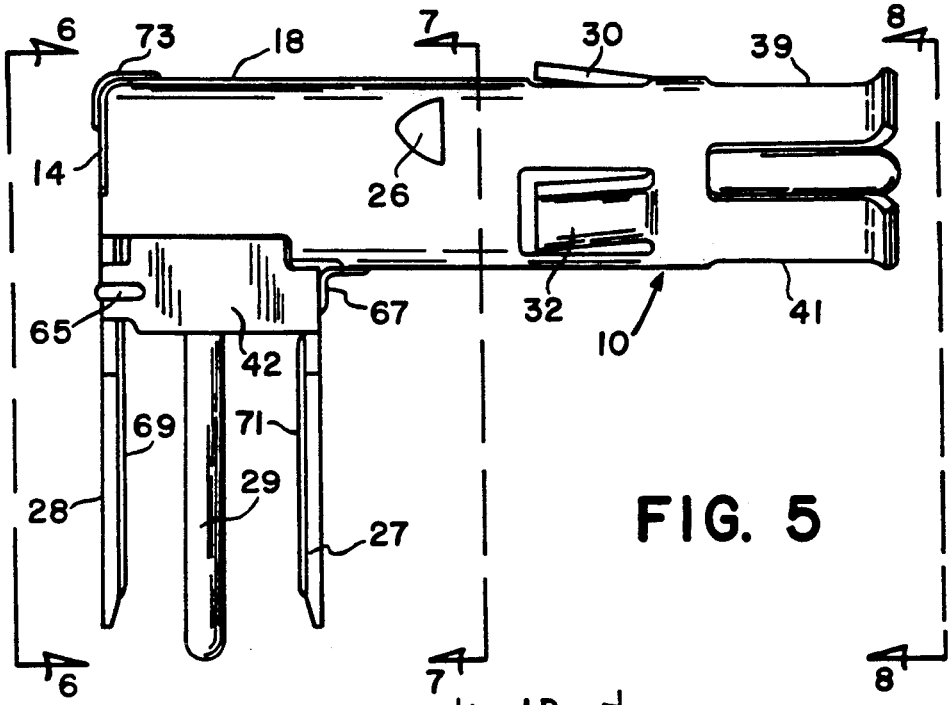
FIG. 5 is a side view of the receptacle connector illustrated in FIG. 1.

Column 5, line 65, "FIG. 4;" should read --FIG. 24;--.

Column 6, line 3, "FIG. 4;" should read --FIG. 24;--.

Column 8, line 58, "connector 1?" should read --connector 10--.

Column 8, line 65, "120 increments" should read --120° increments--.

Column 9, line 64, "the shell" should read --the shell 18--.

Column 10, lines 19-20, "conductor would" should read --conductor 20 would--.

Column 10, lines 29-30, "processes controlled" should read --processes can be controlled--.

Column 10, line 35, "FIGS. 16, 17, and" should read --FIGS. 16, 17, and 18--.

UNITED STATES PATENT AND TRADEMARK OFFICE

CERTIFICATE OF CORRECTION

PATENT NO. : 5,060,373

DATED : October 29, 1991

INVENTOR(S) : Machura, et al.

It is certified that error appears in the above-identified patent and that said Letters Patent is hereby corrected as shown below:

Column 10, line 45, "means of" should read --means 11 of--.

Claim 5, column 15, line 10, "a portion" should read --a body portion--.

Claim 8, column 15, line 30, "steps" should read --step--.

Signed and Sealed this

Seventh Day of September, 1993

Bruce Lehman

*Attest:*

BRUCE LEHMAN

*Attesting Officer*

*Commissioner of Patents and Trademarks*